United States Patent [19]

Rubinstein

[11] Patent Number: 4,817,869

[45] Date of Patent: Apr. 4, 1989

[54] ROTATING MINIATURE SPRINKLER FOR IRRIGATION SYSTEMS

[76] Inventor: Zvi Rubinstein, 14 Ilan Street, Givat Shaul, Israel

[21] Appl. No.: 102,510

[22] Filed: Sep. 29, 1987

Related U.S. Application Data

[62] Division of Ser. No. 789,453, Oct. 21, 1985, Pat. No. 4,754,925.

[30] Foreign Application Priority Data

Oct. 24, 1984 [IL] Israel ..... 73294
Sep. 24, 1985 [IL] Israel ..... 76483

[51] Int. Cl.[4] ..... B05B 3/08
[52] U.S. Cl. ..... 239/222.17; 239/233
[58] Field of Search ..... 239/222.11–222.19, 239/380, 381, 383, 230, 231, 228, 233, 498, 505, 506, 507, 514, 515, 203–206, 524

[56] References Cited

U.S. PATENT DOCUMENTS

| | | | |
|---|---|---|---|
| 2,975,981 | 3/1961 | Cockman | 239/383 |
| 3,309,025 | 3/1967 | Malcolm | 239/230 |
| 3,432,102 | 3/1969 | Turner et al. | 239/255 |
| 4,121,769 | 10/1978 | Pesri | 239/222.17 |
| 4,177,944 | 12/1979 | Wichman | 239/230 |
| 4,231,521 | 11/1980 | Hermine | 239/228 |
| 4,369,922 | 1/1983 | Vikre | 239/506 |
| 4,538,689 | 4/1986 | Rosenburg | 239/381 |

FOREIGN PATENT DOCUMENTS

| | | |
|---|---|---|
| 88977 | 1/1982 | Australia . |
| 539957 | 4/1983 | Australia . |
| 0118630 | 3/1983 | European Pat. Off. . |
| WO82/00962 | 4/1982 | PCT Int'l Appl. . |
| WO83/03064 | 9/1983 | PCT Int'l Appl. . |
| 634542 | 12/1947 | United Kingdom . |
| 742439 | 10/1953 | United Kingdom . |
| 744228 | 12/1953 | United Kingdom . |
| 734455 | 5/1954 | United Kingdom . |
| 2079632 | 1/1982 | United Kingdom . |
| 2138323 | 10/1984 | United Kingdom . |

*Primary Examiner*—Andres Kashnikow
*Assistant Examiner*—Kevin P. Weldon
*Attorney, Agent, or Firm*—Pollock, Vande Sande & Priddy

[57] ABSTRACT

A miniature sprinkler has a fixed vertically extending nozzle in communication with a supply pipe and includes a flow diverter having an axially extending inlet in register with the nozzle outlet. The diverter is rotatably mounted by an axially extending shaft loosely retained in a bushing at the top of the nozzle. The diverter inlcudes a the side outlet and an open arcuate channel between the inlet and side outlet from which the water is emitted in the form of a jet. The drive apparatus includes at least one blade affixed adjacent the periphery of the flow diverter and at least partially aligned with the diverter outlet so that at least part of the flow from the diverter outlet impinges on the blade to cause the rotation of the diverter. The blade is being shaped such as to change the direction of the flow of water impinging thereupon. The diverter is axially movable relative to the nozzle to close the outlets and the nozzle in the absence of water flowing through the nozzle.

9 Claims, 11 Drawing Sheets

ROTATING MINIATURE SPRINKLER FOR IRRIGATION SYSTEMS

This is a division of application Ser. No. 789,453 filed Oct. 21, 1985 now U.S. Pat. No. 4,754,925.

FIELD OF THE INVENTION

The present invention relates to sprinklers for irrigation systems.

BACKGROUND OF THE INVENTION

Sprinklers for irrigating plots of land have long been known in the art. Sprinklers generally comprise one or more nozzles which rotate and provide outflowing jets of water over a relatively large range. These sprinklers are generally large in size and relatively costly to manufacture. They include seals used for sealing and friction purposes and, therefore, are sensitive to dirt which can stop their rotation.

Miniature sprinklers are known which are constituted by a fixed nozzle attached by any suitable means to a water supply line. These nozzles are mounted opposite a rotating diverter, generally constituted by a disc, a rectangular element, or the like, which is provided with a diametrically extending channel, the ends of the channels being curved relative to the diameter in the same rotational sense. This curvature causes the jet from the nozzle to rotate the diverter and, in the opposite rotational sense, directs the outflowing water so that it irrigates the circular area surrounding the nozzle. Thus, the same element which divides the flow also serves to cause rotation of the diverter.

While these miniature sprinklers are small in size and relatively inexpensive to manufacture, they suffer from a number of disadvantages. They rotate at very high speed so the water outflow therefrom is in the form of droplets, not a jet. They can only be used in areas which are protected from the wind. Their range is small (i.e., 10 meters), and the relatively small droplets spread thereby often lack sufficient force to penetrate through the leaves of the plants they are required to irrigate. Another disadvantage is that the outlet channels remain open when the sprinkler is not in operation, and insects and foreign matter often enter the nozzle through the channels and clog the sprinkler.

A solution to the latter problem of insects entering the open outlet channels has been proposed including a bath-like element disposed beneath the rotating diverter. The diverter is arranged for vertical movement within the bath whereby, when the water is turned off, the entire rotating diverter is retracted into the bath. Due to the size of the bath element, it is complicated to adapt the device to existing sprinkler systems, requiring modification of the bridge member, which in turn attracts pests which damage the sprinkler. Furthermore, this element is complicated to manufacture, assemble and disassemble, and requires substantial maintenance.

SUMMARY OF THE INVENTION

It is thus an object of the present invention to provide a small sprinkler which combines the advantages of a conventional sprinkler insofar as range, droplet size and penetrating force of the jet are concerned, with the small size and low cost of manufacture of conventional miniature sprinklers. In fact, it has been found in one embodiment of the present invention that if the rotational speed of the miniature sprinkler is 1 rps or less, its characteristics are even better than those of the conventional sprinkler. Further advantages include exceptionally low production costs, small size, no seals or springs required, simple maintenance, and the possibility of closing the outlets of the sprinkler or of providing a pop-up arrangement by simple means, if desired.

There is thus provided in accordance with the present invention a miniature sprinkler of the kind having a fixed vertically extending nozzle in communication with a supply pipe, the improvement comprising a flow diverter having an axially extending inlet in register with the nozzle outlet rotatably mounted at the top of the nozzle, the inlet in the diverter merging into at least one side outlet which extends horizontally or at an angle to the horizontal and from which the water is emitted in the form of a jet, and drive means cooperating with the diverter in such a position that at least part of the flow from the diverter outlet impinges on the drive means to cause the rotation of the diverter, wherein the drive means is distinct from the flow dividing portion of the flow diverter.

The drive means may comprise a static element, e.g., a wire whose ends are slightly bent and which is mounted on the diverter. Or the drive means may comprise a rotating element which is mounted on the axis of the diverter or is connected with its wall and extends outwardly.

The diverter may be mounted by an axially extending shaft in a known bridge member fixed to the nozzle. Alternatively, it may be mounted for rotation at the top of the nozzle which includes means to mount the diverter so that it can freely rotate.

According to a preferred embodiment of the invention, the diverter is constructed and adapted so as to close the nozzle when there is no water flow therethrough.

There is also provided in accordance with the present invention a miniature sprinkler of the kind having a fixed vertically extending nozzle in communication a flow diverter having an axially extending inlet in register with the nozzle outlet rotatably mounted at the top of the nozzle, the inlet in the diverter merging into at least two side outlets which extend horizontally or at an angle to the horizontal and from which the water is emitted in the form of a jet, and drive means cooperating with the diverter in such a position that at least part of the flow from the diverter outlet impinges on the drive means to cause the rotation of the diverter, wherein the diverter is axially movable relative to the nozzle and is adapted to cover the outlets and the nozzle when no water flows through the nozzle.

According to a preferred embodiment of the invention, the nozzle defines a cup-shaped portion within which the diverter is axially movable in response to water flow through the nozzle.

Further according to a preferred embodiment, the drive means comprise a pair of wedge-shaped blades affixed adjacent the periphery of the flow diverter and at least partially aligned with the diverter outlets.

BRIEF DESCRIPTION OF THE DRAWINGS

The present invention will be more clearly understood and appreciated from the following detailed description taken in conjunction with the drawings in which.

DETAILED DESCRIPTION OF THE INVENTION

Figure 1A:
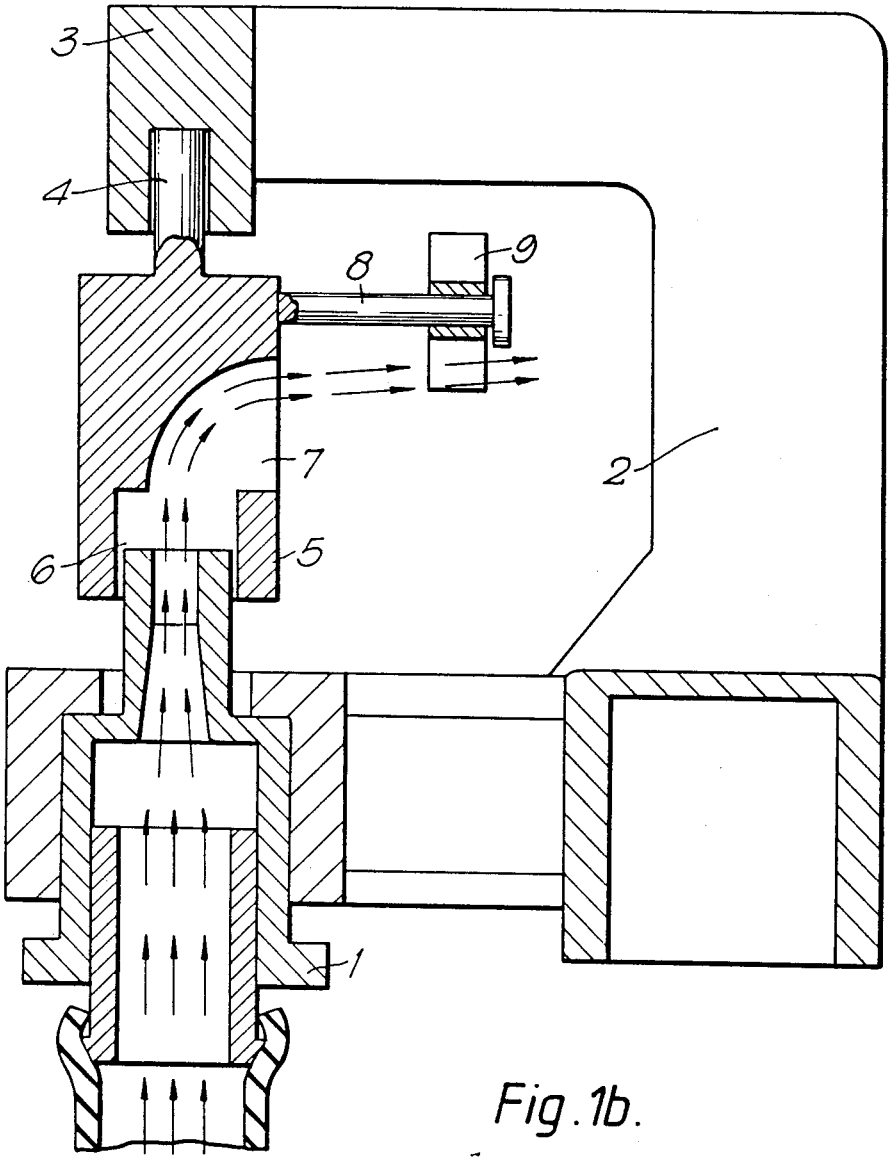
FIG. 1*a* shown one embodiment of a sprinkler constructed and operative in accordance with the invention in elevational cross-section.
Figure 1B:
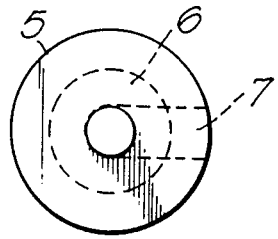
FIG. 1*b* illustrates a schematic plan view of a detail thereof.

Referring to FIGS. 1*a* and 1*b*, there is shown a miniature sprinkler constructed and operative in accordance with the present invention and comprising a spray nozzle 1 mounted within a conventional C-shaped bridge member 2, the connection of the nozzle 1 to the water supply not being shown. At the end of the top leg of bridge member 2, a bushing 3 extends downwardly, the shaft 4 of a substantially cylindrical flow diverter 5 being rotatable within bushing 3.

The flow diverter 5 has a bottom aperture 6 which surrounds nozzle 1 and constitutes the inlet into the diverter of the jet of water emerging from nozzle 1. Inlet 6 merges into a sidewardly extending outlet 7, which can be seen in bottom sectional view in FIG. 1*b*.

Above outlet 7, a horizontally extending shaft 8 is mounted on diverter 5, the end of the shaft carrying drive means 9. Drive means 9 is mounted in such a position that at least part of the flow from the outlet of the diverter impinges on the drive means to cause rotation of the diverter. In the embodiment of FIGS. 1*a* and 1*b*, drive means 9 comprises a turbine wheel, the lower half of the turbine wheel being in alignment with at least part of outlet 7, the blades of the turbine 9 being of suitable construction.

As used throughout the specification and claims, the term turbine is intended to include any rotating element defining a plurality of peripheral teeth or blades, including a propeller.

It can be seen that as a jet emerges from nozzle 1 and flows through diverter 5, it will hit the blades of the turbine 9 which rotate around axis 8, thereby causing rotation of the entire diverter around nozzle 1. Operation of such turbines is known, wherein the turbine is freely mounted for rotation about an axle affixed to the diverter whereby the turbine hits its axle when the jet of water impinges on it, thereby causing the diverter to rotate incrementally.

The orientation and construction of the blades of the turbine 9 are predetermined for the speed of rotation and form of irrigation desired. If a slower rotation is required, the orientation of the blades is adapted accordingly.

It is a particular feature of the present invention that there is provided a sprinkler including a vertical nozzle, a diverter arranged to divert the water from the nozzle into a substantially horizontal jet or jets, and drive means which are distinct from the flow dividing portion of the flow diverter, which is not known in conventional miniature sprinklers. According to a preferred embodiment, the drive means comprises a turbine arranged to rotate at a rapid rate when at least part of the flow of water impinges thereon and arranged to cause the diverter to rotate at a slow rate.

Alternate embodiments of the present invention will now be discussed with reference to the drawings. In these drawings, those parts which are the same as those in FIG. 1*a* are designated by the same reference numerals, and the description of their function will not be repeated.

Figure 2A:
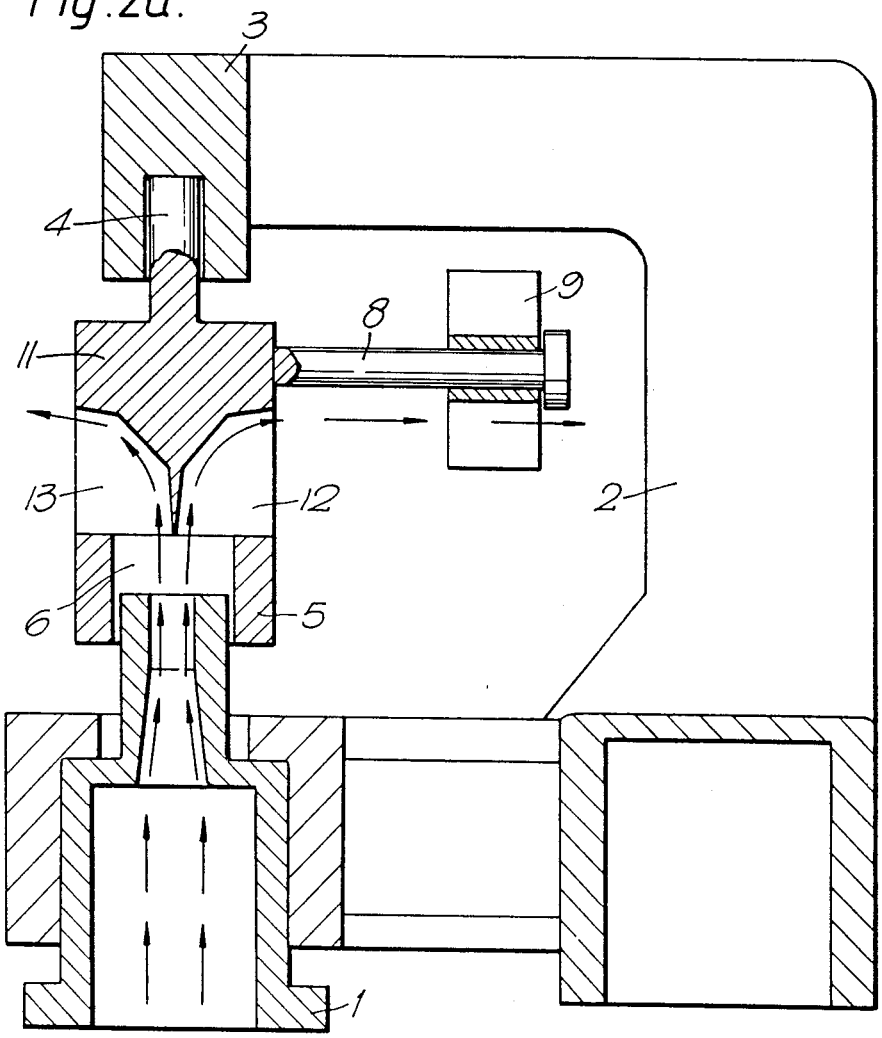
FIG. 2*a* shown another embodiment of the invention in elevational cross-section.
Figure 2B:
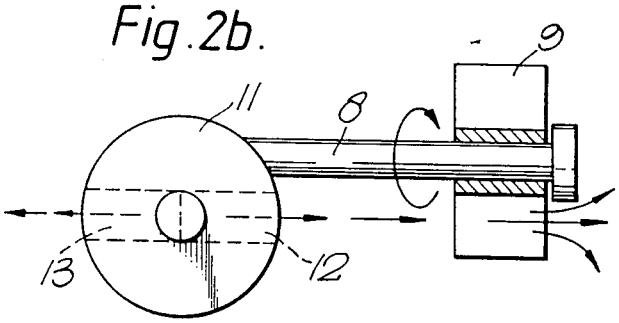
FIG. 2*b* illustrated a schematic plan view of a portion thereof.

Referring now to FIGS. 2*a* and 2*b*, there is shown a diverter 11 surrounding nozzle 1 and extending with its shaft 4 into bushing 3 of bridge member 2. The diverter of this embodiment is shown with bottom aperture 6 merging into two diametrically opposed outlets 12 and 13. Drive means 9 mounted on shaft 8 is arranged at least partially in the flow path of one of the outlets 12. The flow from nozzle 1 is indicated by the arrows in FIG. 2*a* and the movement of diverter 11 and drive means 8 and 9 are indicated by the arrows in FIG. 2*b*.

It will be appreciated that although drive means 9 has been illustrated as a turbine, any other drive means may alternately be employed.

Figure 3:
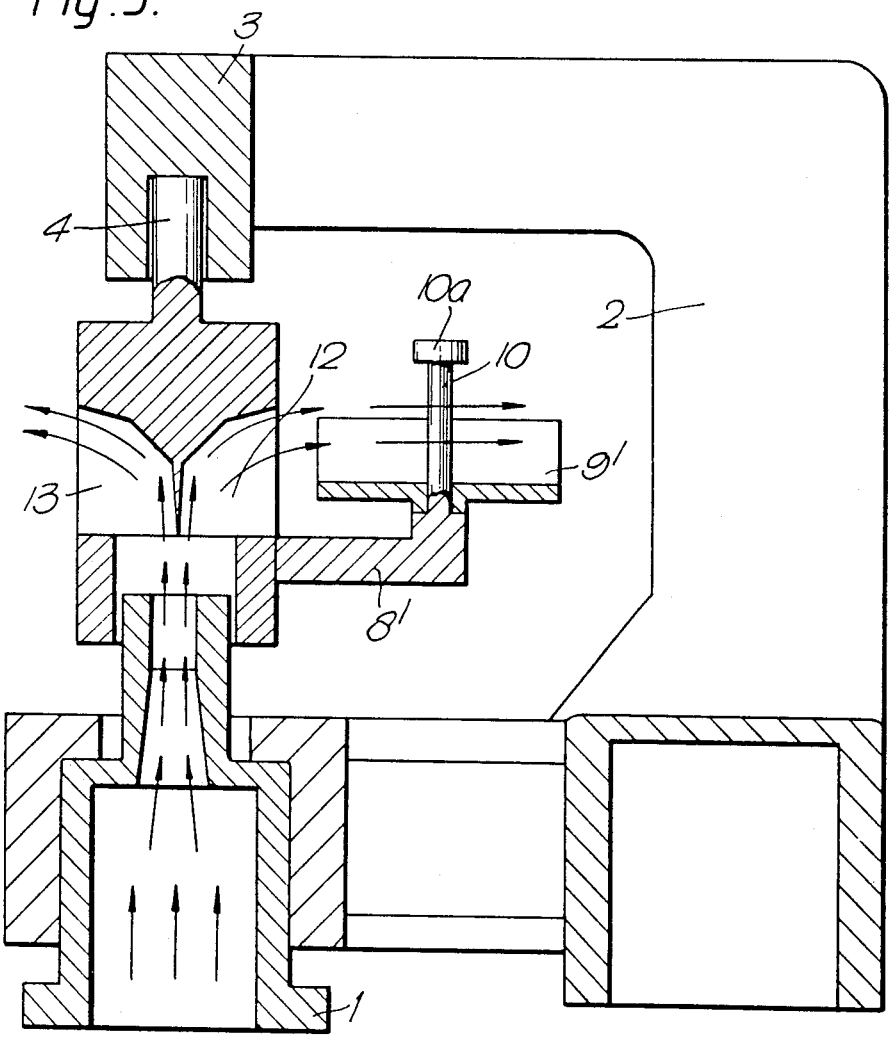
FIG. 3 shows an alternate embodiment of the present invention.

With reference to FIG. 3, there is shown an alternate embodiment of the invention, those parts which are the same as those in the embodiment of FIG. 2*a* being designated by the same reference numerals. The drive means in this embodiment comprises a turbine 9′, arranged to rotate around a vertical shaft 10 integral with a horizontally extending shaft 8′ mounted below side outlet 12, the blades of turbine 9′ being in alignment with said outlet. The shaft 10 is of sufficient length to permit the vertical movement of turbine 9′ along the length of shaft 10 so that it will always receive maximum flow from outlet 12. A stop 10*a* is provided on top of shaft 10 to limit the upward movement of turbine 9′.

Figure 4A:
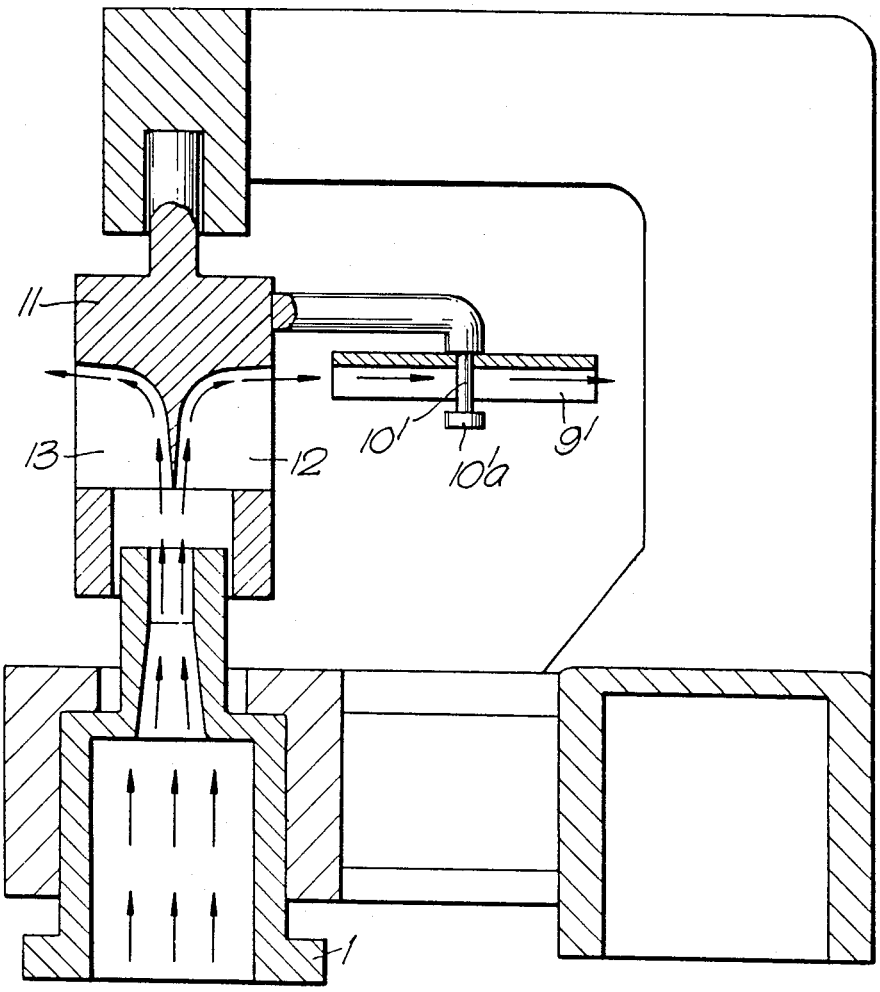
FIG. 4*a* illustrates a further embodiment of the present invention.
Figure 4B:
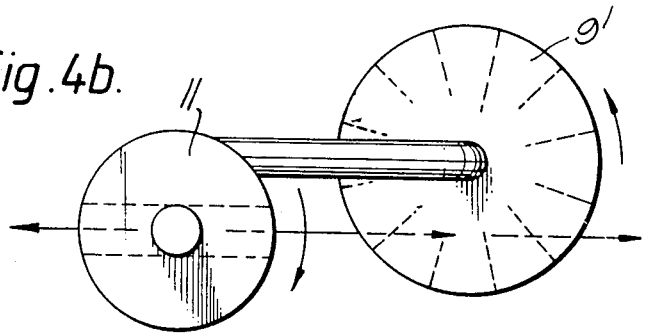
FIG. 4*b* shows a schematic detail of FIG. 4*a;*

The embodiment of FIGS. 4*a* and 4*b* includes drive means comprising a turbine 9′ mounted on a vertical shaft 10′ extending downwardly from a horizontally extending shaft 8″, the blades of the turbine 9′ being in alignment with part of outlet 12. The rotation of diverter 11 and turbine 9′ and the flow of the jet are shown in FIG. 4*b* by means of the arrows.

Figure 5:
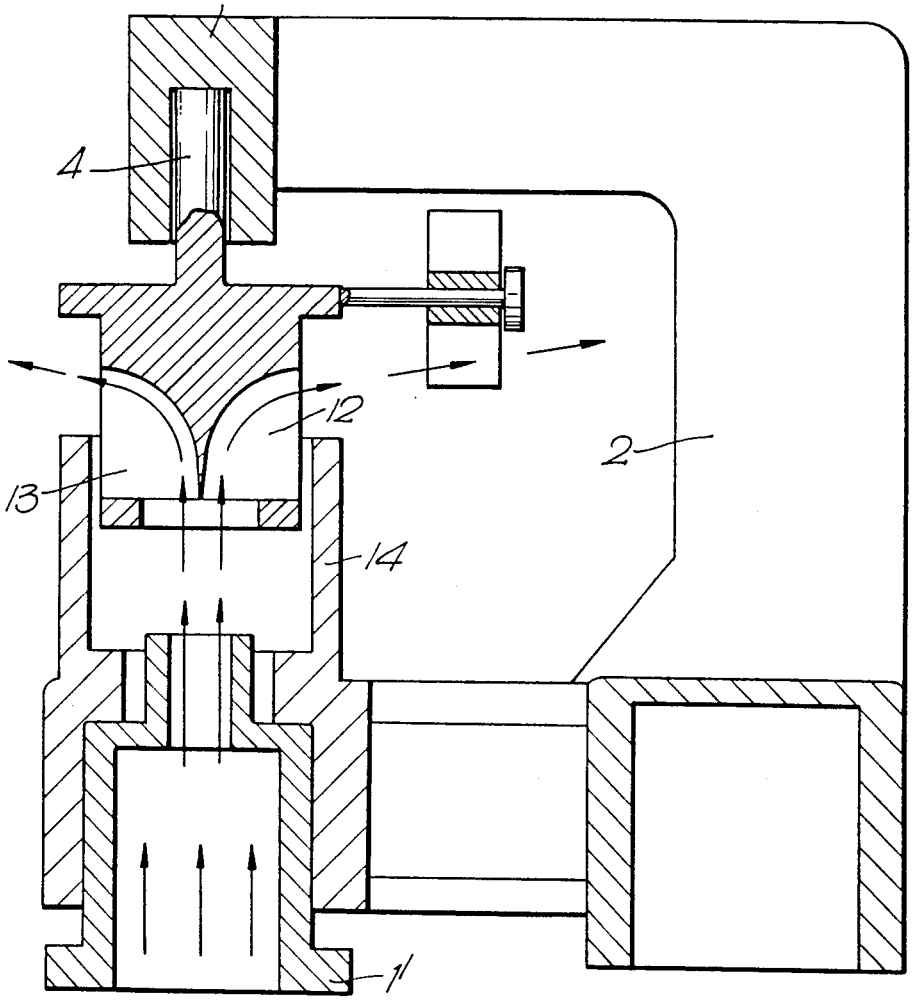
FIG. 5 illustrates another embodiment of the invention.

The construction of the diverter and turbine in the embodiment of FIG. 5 is substantially the same as that of FIG. 2. However, in this embodiment an outlet of the nozzle 1′ leads into a cup-shaped member 14 mounted on the bottom leg of bridge member 2, cup-shaped member 14 surrounding diverter 11. During during the operation of the sprinkler, i.e., when water flows through nozzle 1′, diverter 11 is lifted by the force of the water leaving a space between the outlet of the nozzle and the bottom of diverter 11 and permitting the outflow of water jets via outlets 12 and 13. When no water flows through nozzle 1, the diverter body drops downward so that outlets 12 and 13 are covered by the walls of cup-shaped member 14. This will prevent insects or dirt from entering the diverter and nozzle.

Figure 6:
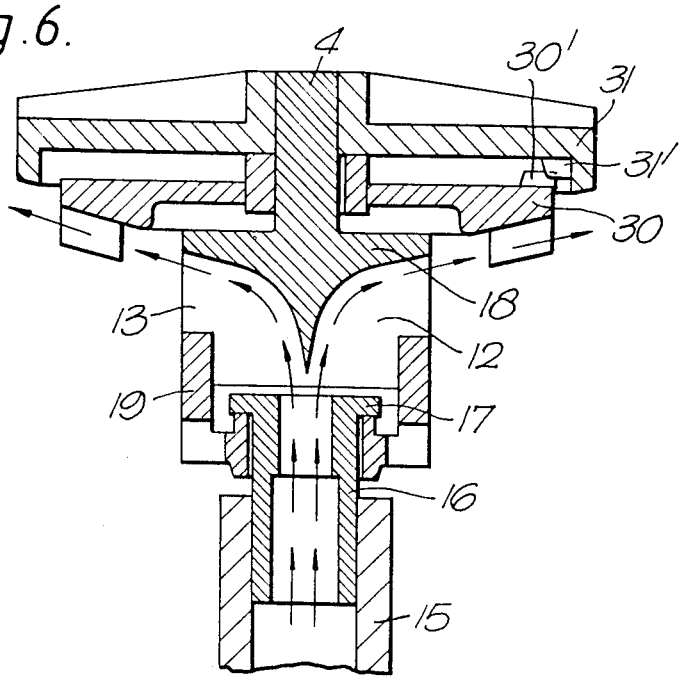
FIGS. 6, 7 and 8 shown vertical sections of three additional embodiments of the mounting of the flow diverter.
Figure 7:
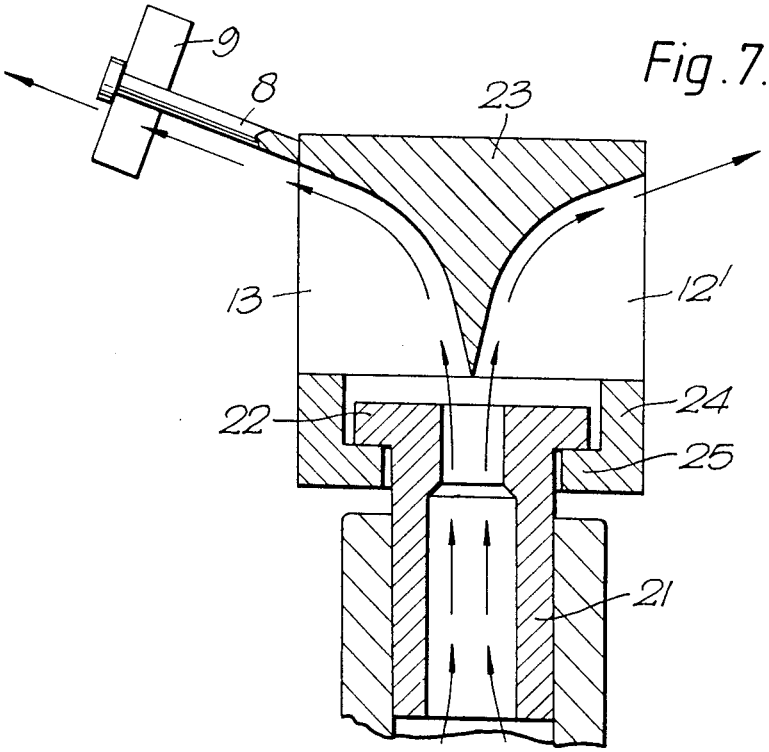
Figure 8:
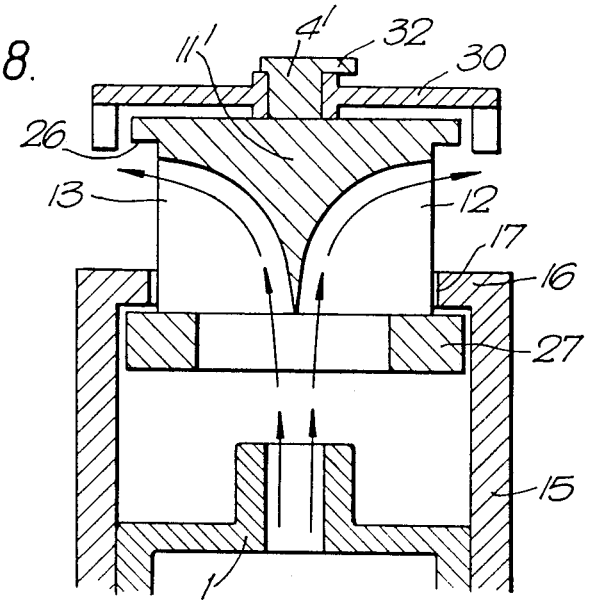

FIGS. 6 to 8 illustrate alternate embodiments of the invention wherein the diverter is mounted in such a way as to rotate around the nozzle without the use of a bridge member. Means are provided to prevent the disengagement of the diverter from the nozzle during rotation of the diverter. For this purpose, as shown in FIG. 6, a cylinder 15 is coupled to the fixed nozzle head 16 which defines an annular top flange 17. The diverter body 18 having side outlets 12 and 13 is provided with a downwardly extending cylindrical member 19 defining bearings which engage flange 17.

The drive means in FIG. 6 are constituted by a turbine wheel 30 fixed for rotation about shaft 4 which is integral with the diverter body. The flow from outlets 12 and 13 impinges on the blades of wheel 30 causing it to rotate. A leg 30′ on top of wheel 30 is adapted to hit a corresponding protrusion 31′ on a cover member 31 mounted on shaft 4. During rotation, the impact of leg 30′ against protrusion 31′ causes the diverter to rotate.

In the embodiment of FIG. 7 there is provided a nozzle head 21. The top of nozzle head 21 is surrounded by an annular flange 22, a diverter body 23 with its side outlets 12′ and 13 having a downward cylindrical extension 24 with an in turned annular flange 25 engaging below flange 22. The drive means for the diverter may be any of those described above or, as shown in FIG. 7, a turbine wheel mounted on a shaft affixed to the diverter. The angle of the shaft relative to the diverter is such that the flow from outlet 13 impinges on the blades of turbine 9.

It is a particular feature of this embodiment that the curvature of outlet 12′ differs from that of outlet 13, whereby the levels of the jet outflow are different. The result is a difference in range of irrigation by the jet flowing from outlet 12′ than from that of outlet 13. It will be appreciated that any embodiment of the present invention can incorporate this feature, if desired.

In the embodiment of FIG. 8, the top of the nozzle 1 is surrounded by a cylinder 15 having a flange 16 wherein an aperture 17 is provided. The diverter 11′ which extends through aperture 17 is provided at its top with an integral shoulder 26 and at its bottom with an annular stop 27 which engages below flange 16. At the top, a turbine wheel 30, similar to that illustrated in FIG. 6, is mounted to a shaft 4′, a stop 32 integral with said shaft preventing the upward movement of the turbine wheel. In this embodiment, it can be seen that the force of the water flowing through nozzle 1 serves to raise diverter 11′ permitting the outflow of water jets via outlets 12 and 13. When no water flows through nozzle 1, the diverter 11′ will drop downwards whereby shoulder 26 abuts against flange 16 and closes the top of the nozzle 1 as well as outlets 12 and 13.

The complementary parts of the diverter and the nozzle described with relation to FIGS. 6 to 8 permit the rotation of the diverter around the nozzle and constitute both a mounting for the diverter and an axis of rotation therefor.

Figure 9:
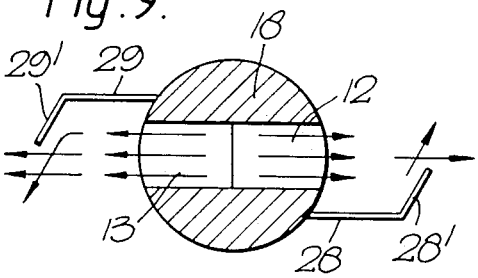
FIGS. 9, 10 and 11 show schematically a further three different embodiments illustrating drive means according to the invention.
Figure 10:
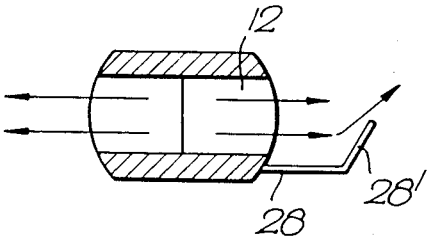
Figure 11:
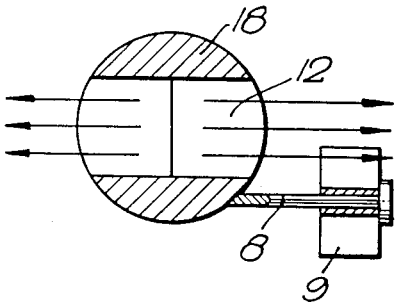

The diverters of FIGS. 6 to 8 may be provided with the drive means as shown, or any of the drive means illustrated in any of the other drawings, or with any other suitable drive means which is independent of the flow divider. A number of suitable alternate drive means are illustrated in FIGS. 9 to 11. In the embodiment of FIG. 9, the drive means comprises wires 28 and 29 extending substantially parallel to the axes of outlets 12 and 13 respectively from near said openings in diametrically opposite positions. The ends 28′,29′ of said wires are bent at an angle so that they are in alignment with part of said outlets. As the flow therefrom impinges on the bent ends 28′, 29′, the diverter will rotate.

The drive means illustrated in FIG. 10 comprises a single wire 28 with a bent end 28′ in alignment with outlet 12, the flow from outlet 13 of the diverter 18 being horizontally outward. Thus, the area irrigated by the jets from the two outlets is not symmetrical In FIG. 11, the drive means comprises a turbine 9 rotatably mounted on a horizontally transverse shaft 8 in such a manner that part of the blades of turbine 9 are at all times in alignment with outlet 12.

Figure 12:
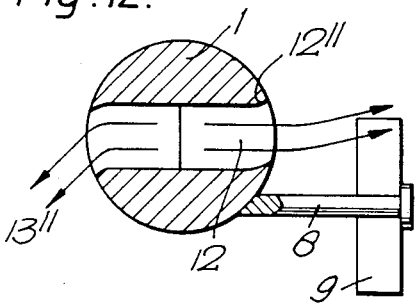
FIG. 12 illustrates another embodiment of the invention.

In FIG. 12, the drive means for the diverter 18 are those described with reference to FIG. 11, i.e., turbine 9 mounted on shaft 8. The outlets 12 and 13 are slightly angled at their ends 12″ and 13″ respectively, the flow from outlet 12″ impinging on the blades of turbine 9. The slant of the ends of the outlets is at a pre-determined angle and may be provided in any of the above-described embodiments, if desired, to enhance or hinder the speed of rotation, depending upon whether the slant is in the direction of rotation or opposite the direction of rotation.

The invention s not limited to the number of outlets from the diverter of the present invention or to the number of drive means for the diverter above described. It is within the scope of the invention to provide any suitable number of drive means on the diverter and any desired number of outlets.

Figure 13A:
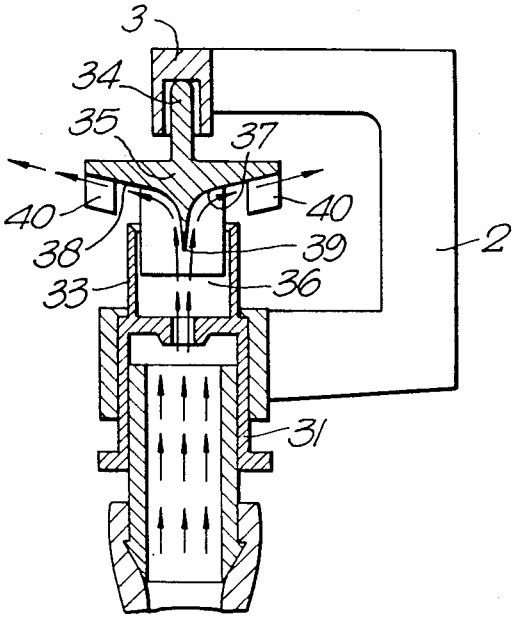
FIG. 13*a* shows a further embodiment of a sprinkler according to the invention in elevational cross-section during operation.

Referring now to FIG. 13*a* there is shown a sprinkler similar to that shown in FIG. 5 in its open or operational orientation. The sprinkler comprises a spray nozzle 31 mounted within a bridge member 2, the shaft 34 of a substantially cylindrical flow diverter 35 being rotatable within bushing 3 on bridge member 2. According to this embodiment, nozzle 31 itself defines a cup-shaped upper portion 33. Flow diverter 35 defines a bottom aperture 36 which merges into diametrically opposed outlets 37 and 38. In this embodiment, the dividing edge 39 of flow diverter 35 is perpendicular to the longitudinal axis of the outlets 37 and 38.

Figure 13B:
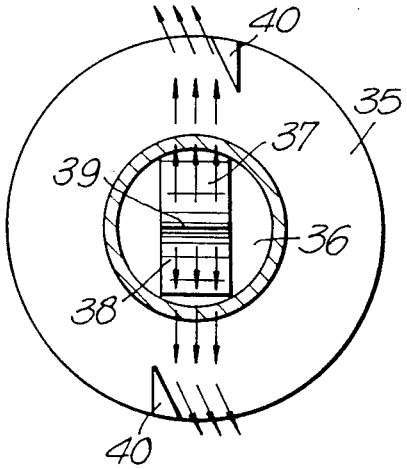
FIG. 13*b* shows an enlarged schematic plan view of a detail of FIG. 13*a;*

Mounted adjacent the periphery of flow diverter 35 are drive means 40. According to this embodiment, drive means 40 comprise two wedge-shaped blades mounted adjacent the periphery of flow diverter 35 and at least partially in the flow path of the jet emerging from nozzle 31, as illustrated by the arrows in FIG. 13*b*. The force of the jet impinging on blades 40 causes the flow diverter to rotate.

Figure 14:
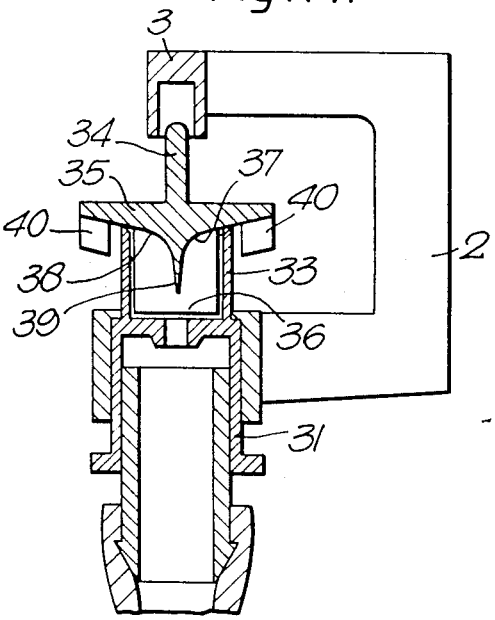
FIG. 14 shows the sprinkler of FIG. 13*a* in a closed orientation.

It is a particular feature of this embodiment that when no water flows through nozzle 31, flow diverter 35 descends axially, as shown in FIG. 14, and seats within cup-shaped portion 33 of nozzle 31, thereby closing outlets 37 and 38. This serves to prevent the ingress of insects into the sprinkler when it is not operating. When the sprinkler is turned on, the force of the water jet impinging on flow diverter 35 causes the flow diverter to rise to the orientation of FIG. 13*a*, thereby uncovering outlets 37 and 38 to permit irrigation of the area around the sprinkler.

It is a further particular feature of this embodiment that the drive means are located on the flow diverter itself, independently of the dividing edge 39 of the diverter, rather than on a shaft affixed to the diverter. This provides rapid and efficient rotation of the sprinkler in operation, while permitting inexpensive production thereof.

Figure 15A:
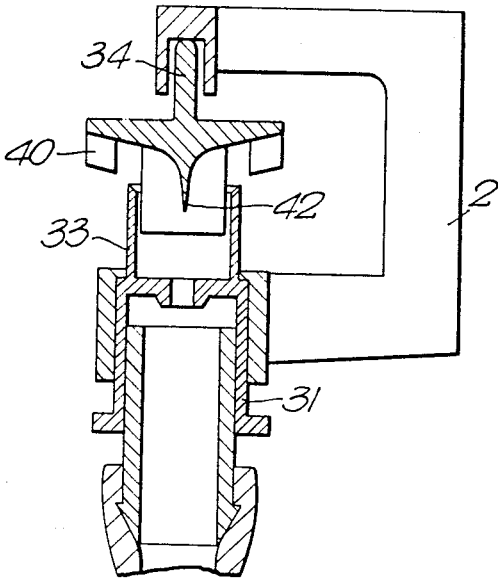
FIGS. 15*a* and 15*b* illustrate an alternate embodiment of the sprinkler of FIG. 13*a* and a schematic plan view of a portion thereof, respectively.
Figure 15B:
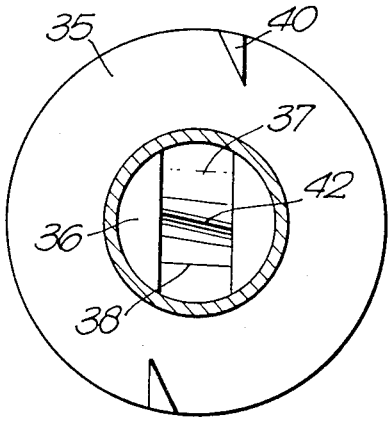

Referring now to FIGS. 15*a* and 15*b*, there is shown a sprinkler substantially identical to that shown in FIGS. 13*a* and 14 and similar elements have similar reference numerals. In this embodiment it can be seen that the dividing edge 42 of the flow diverter 35 is angled with respect to the longitudinal axis of the outlets 37 and 38. This serves to prevent stoppage of rotation caused by dirt or foreign particles in the water supply. Rotation of the flow diverter is insured because water impinging anywhere on the diverter will be diverted in a manner to provide maximum moment thereof.

Figure 20:
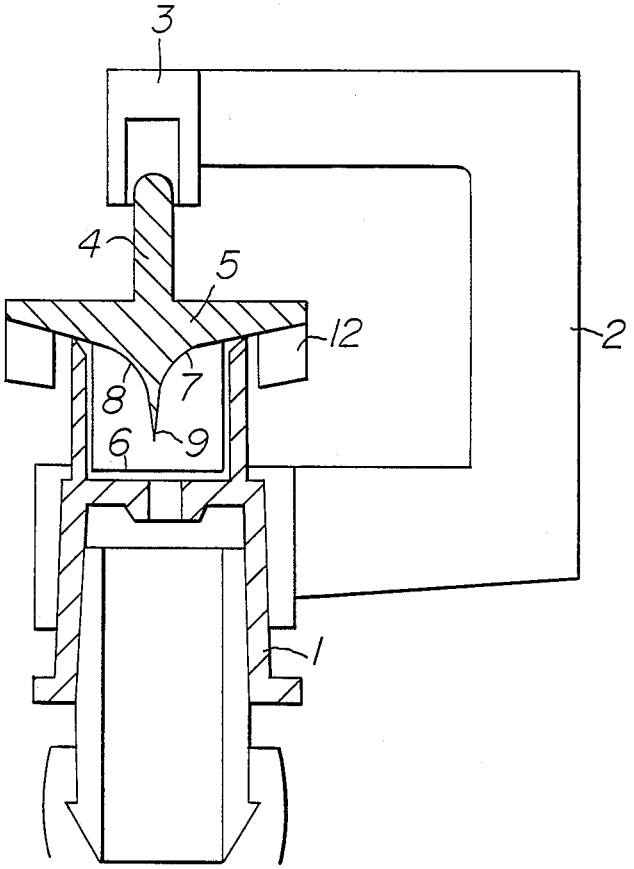
FIG. 20 illustrates a miniature sprinkler constructed and operative in accordance with still another embodiment of the present invention.

Alternately, instead of the water flow from the nozzle impinging upon the center of the flow divider, the nozzle can be arranged so that the water impinges off center of the flow This can be accomplished, for example, if the bushing in which the flow diverter is mounted is disposed eccentrically relative to the nozzle (see FIG. 20) divider. This eccentric impingement of the water flow provides a non-circular irrigated area about the sprinkler, such as when the area to be irrigated is elliptical or only a portion of a circle. This feature can be incorporated into any of the sprinklers according to the present invention.

Furthermore, it will be appreciated that while at least two flow outlets are desired in this embodiment of the miniature sprinkler, any greater number of flow outlets may alternatively be provided by the flow divider, depending upon the desired distribution of the water flow. Similarly, each of the flow outlets may be at a different level, thereby producing an outflowing jet of a different height and range.

According to the embodiments illustrated in FIGS. 13*a* and 15*a*, cup-shaped portion 33 constitutes an integral portion of nozzle 31. Alternately, the cup-shaped portion may be provided coupled to the bridge member 2 or integral therewith, the water flowing from nozzle 31 through the cup-shaped member into inlet 36 of the flow diverter.

It is a particular feature of this embodiment of the invention that closure of the sprinkler can be provided by separating the flow diverter from the drive means. The nozzle and flow diverter are protected and enclosed within the cup-shaped member, while the drive means can remain outside with no detrimental effects.

Figure 16:
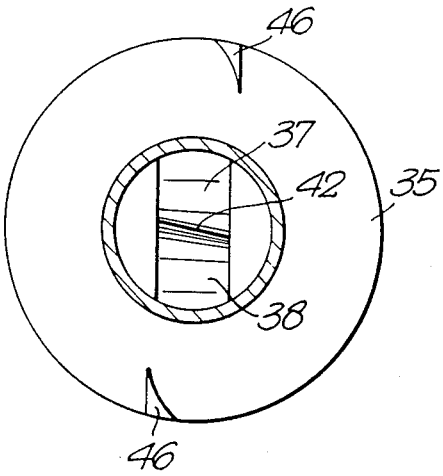
FIG. 16 illustrates the flow diverter of a miniature sprinkler constructed and operative in accordance with an alternate embodiment of the present invention.

Turning now to FIG. 16 there is shown a detail view of a flow diverter constructed and operative in accordance with an alternate embodiment of the present invention. This flow diverter is similar to that shown in FIG. 15*b*, like elements being noted by like reference numerals. The difference in FIG. 16 is the shape of the drive means 46 which are arcuate. It will be appreciate that any shape drive means which causes a change in the direction of the water flow, and thereby causes the flow diverter to rotate, may be employed in this embodiment of the present invention.

Figure 17:
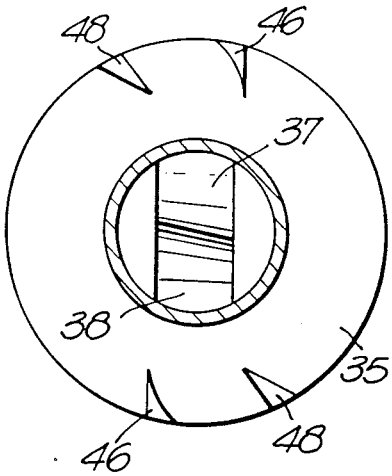
FIG. 17 illustrates the flow diverter of a miniature sprinkler constructed and operative in accordance with another embodiment of the present invention.

With reference to FIG. 17 there is shown a detail view of a flow diverter according to yet another embodiment of the present invention. This flow diverter is substantially identical to that of FIG. 16 with the addition of flow restrictor elements 48. Flow restrictor elements 48 of any desired shape may be provided adjacent drive means 46 in order to limit the flow of water in a particular direction. This permits the user to affect the water distribution characteristics at will.

Figure 18:
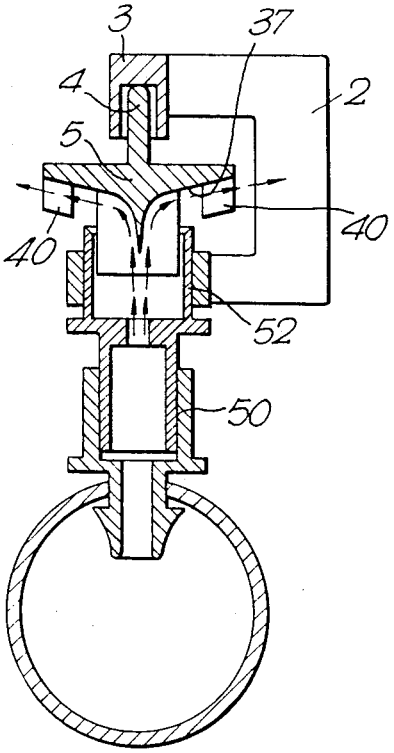
FIG. 18 illustrates a miniature sprinkler constructed and operative in accordance with an alternate embodiment of the present invention in elevational cross-section.

Referring now to FIG. 18 there is shown a miniature sprinkler constructed and operative in accordance with an alternate embodiment of the present invention in elevational cross-section. This embodiment is a miniature version of the sprinkler according to the invention, being smaller in size that the above described embodiments. Like elements have been designated by like reference numerals. The sprinkler of this embodiment comprises a nozzle 50. A cup-shaped element 52 is coupled to bridge member 2 in register with the nozzle. The flow diverter 35 is axially movable within cup-shaped element 52 as described hereinabove. It is an advantage of this embodiment that this structure permits construction and assembly of this sprinkler from smaller elements while retaining substantial irrigation capacity.

Figure 19:
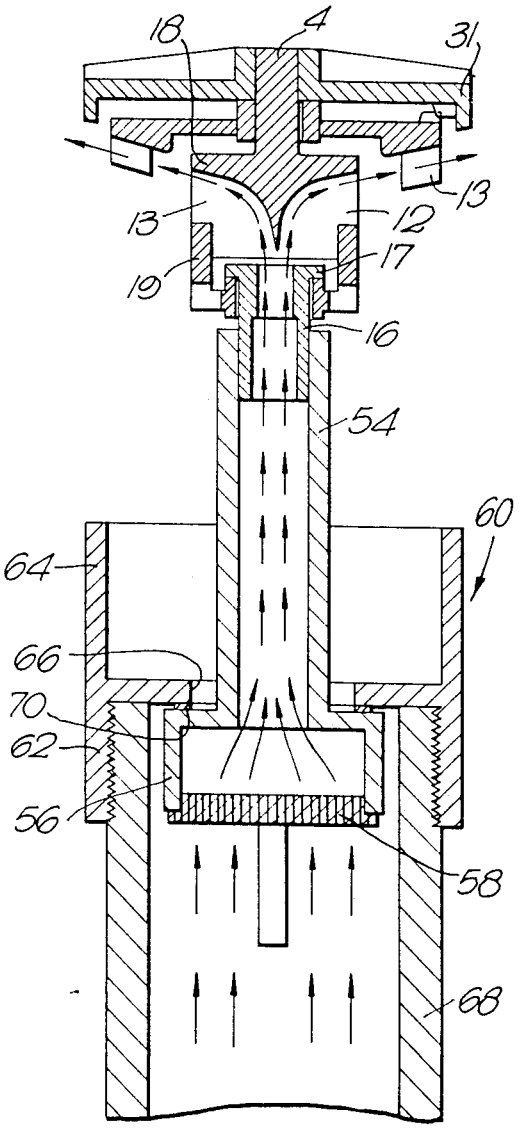
FIG. 19 illustrates a miniature sprinkler constructed and operative in accordance with another alternate embodiment of the present invention.

With reference to FIG. 19 there is shown a miniature sprinkler constructed and operative in accordance with yet another embodiment of the present invention. This embodiment is substantially identical to that of FIG. 6 and illustrates the sprinkler arranged for coupling to any conventional irrigation tube for pop-up action.

The nozzle 16 of the sprinkler is coupled to a rigid pipe 54 as by press fitting. Pipe 54 defines a flanged inlet 56. A filter 58 may optionally be disposed in inlet 56 to remove foreign matter from the water passing into the sprinkler. A cylindrical adapter element 60 defining a lower threaded portion 62, an upper cup-shaped portion 64 and a central aperture 66 is provided. Adapter 60 is arranged for screw engagement with any conventional, substantially vertical pipe 68 in an irrigation system.

Pipe 54 is arranged for reciprocal motion within adapter 60 and pipe 68 and is retained therein by flanged inlet 56. Any known seal 70 may be provided between flanged inlet 56 and adapter 60.

Operation of this embodiment is as follows. When water flows through the system, the miniature sprinkler and pipe 54 pop out of the tubing 68 and operate as described hereinabove. When the water flow ceases, rigid tube 54 reciprocates into the pipe 68, the sprinkler seating within the upper cup-shaped portion 64 of adapter 60. Cover member 31 serves to close the sprinkler within cup-shaped portion 64.

It is a particular feature of the miniature sprinklers of the present invention that they are suitable for insertion into existing sprinkler systems without requiring adaptation of the bridge member of the sprinkler or adaptation of the conventional tubing. Furthermore, due to their size, they are less expensive to manufacture than conventional sprinklers and, in particular the embodiment of FIG. 18, can be utilized for specialized applications.

It will be appreciated by those skilled in the art that the invention is not limited to what has been shown and described hereinabove merely by way of example. Rather, the scope of the invention s limited solely by the claims which follow.

I claim:

1. A miniature sprinkler having a fixed vertically extending nozzle in communication with a supply pipe and comprising:

a flow diverter being rotatably mounted by means of an axially extending shaft, loosely retained in a bushing at the top of the nozzle; said flow diverter including an axially extending inlet in register with the nozzle's outlet, at least one side outlet and at least one open arcuate channel between said inlet and said side outlet, said channel defining a flow path for diverting the water flow, such as to be emitted through said outlet in the form of a jet;

drive means comprising at least one blade affixed adjacent the periphery of the flow diverter and at least partially aligned with the diverter outlet so that at least part of the water flow from the diverter side outlet impinges on said at least one blade to cause the rotation of said diverter, said at least one blade being shaped so as to change the direction of the flow of water impinging thereupon; and wherein the diverter is axially movable relative to the nozzle and is adapted to close said at least one side outlet and the nozzle in the absence of the water flow through the nozzle.

2. A miniature sprinkler according to claim 1 and wherein said sprinkler defines a cup-shaped portion within which the diverter is axially movable in response to water flow through the nozzle.

3. A miniature sprinkler according to claim 1 and wherein said cup-shaped portion is integrally formed with said nozzle.

4. A miniature sprinkler according to claim 1 and wherein said blades comprise wedge-shaped blades.

5. A miniature sprinkler according to claim 1 and wherein said blades define arcuate surfaces.

6. A miniature sprinkler according to claim 1 and wherein said diverter comprises a flow dividing edge arranged perpendicular to the longitudinal axis of said at least one side outlet as seen in plan view.

7. A miniature sprinkler according to claim 1 and wherein said diverter comprises a flow dividing edge arranged at an angle to the longitudinal axis of said at least one side outlet as seen in plan view whereby the water jet from said outlet is aimed substantially at said drive means.

8. A miniature sprinkler according to claim 1 and wherein said flow diverter is mounted for rotation within a bushing, and the nozzle is concentric with said bushing.

9. A miniature sprinkler according to claim 1 and wherein said flow diverter is mounted for rotation within a bushing and the nozzle is eccentric with said bushing.

* * * * *